US005813347A

United States Patent [19]

Baumann

[11] Patent Number: 5,813,347

[45] Date of Patent: Sep. 29, 1998

[54] DEVICE AND METHOD FOR CONTROLLING A PRINTING MACHINE, PARTICULARLY A FRANKING MACHINE DRUM

[75] Inventor: Hervé Baumann, Paris, France

[73] Assignee: SECAP, Boulgne-Billancourt, France

[21] Appl. No.: 750,892

[22] PCT Filed: Feb. 5, 1996

[86] PCT No.: PCT/FR96/00187

§ 371 Date: Dec. 13, 1996

§ 102(e) Date: Dec. 13, 1996

[87] PCT Pub. No.: WO96/26502

PCT Pub. Date: Aug. 29, 1996

[30] Foreign Application Priority Data

Feb. 20, 1995 [FR] France ..... 95 01919

[51] Int. Cl.[6] ..... B41J 1/32

[52] U.S. Cl. ..... 101/486; 101/216; 101/232; 101/91

[58] Field of Search ..... 101/216, 232, 101/233, 235, 91; 318/282, 362, 363, 599, 369

[56] References Cited

U.S. PATENT DOCUMENTS

| | | | |
|---|---|---|---|
| 3,756,149 | 9/1973 | Bishop et al. | 101/228 |
| 4,023,489 | 5/1977 | Beery | 101/235 |
| 4,220,084 | 9/1980 | MacLean et al. | 101/235 |
| 4,232,217 | 11/1980 | Juziuk et al. | 101/233 |
| 4,579,054 | 4/1986 | Buan et al. | 101/91 |
| 4,665,353 | 5/1987 | Salazar et al. . | |
| 4,909,498 | 3/1990 | Rutishauser . | |
| 5,018,443 | 5/1991 | Bolger | 101/235 |
| 5,471,928 | 12/1995 | Dimur et al. . | |

FOREIGN PATENT DOCUMENTS

| | | |
|---|---|---|
| 0 177 057 A2 | 4/1986 | European Pat. Off. . |
| 0 179 945 A1 | 5/1986 | European Pat. Off. . |
| 0 545 769 A1 | 6/1993 | European Pat. Off. . |
| 0 547 922 A2 | 6/1993 | European Pat. Off. . |

*Primary Examiner*—Eugene H. Eickholt

*Attorney, Agent, or Firm*—Hoffmann & Baron, LLP

[57] ABSTRACT

In a printing machine with a rotary drum (1) for franking envelopes (4), each print operation is performed at a constant rotational speed in a given direction, whereafter the direction of rotation of the drum (1) is reversed so that for the next print operation, the rotational speed of the drum (1) may be increased in said direction over a greater angle to achieve said constant speed.

15 Claims, 3 Drawing Sheets

DEVICE AND METHOD FOR CONTROLLING A PRINTING MACHINE, PARTICULARLY A FRANKING MACHINE DRUM

BACKGROUND OF THE INVENTION

The invention concerns controlling a printing machine, particularly controlling a drum type franking machine.

These machines use a rotary print drum to print a mark on envelopes.

In this type of machine the periphery of the print drum receives the postal marks to be printed on the envelope.

The principle of drum printing is as follows. The drum is initially stopped. When an envelope is introduced into the machine the print drum is put in motion and then contacts the envelope to be marked. For the marking to be of good quality the tangential speed of the print drum and the speed at which the envelope moves must be identical when the ink is transferred to the envelope. When the printing phase is finished the print drum is decelerated to a full stop. The speed profile of the movement of the drum is of the trapezoidal type and comprises three phases, constant acceleration, rotation at fixed speed and constant deceleration. This state of the art is perfectly described in document EP-A-0 177 057.

As this type of machine operates at high speed, it is imperative for the unit driving the print drum to be able to accelerate the latter very rapidly. The drive units are currently electric motors of various types; they must have a high torque in order to accelerate said drum as required.

It has already been proposed to reduce the drive torque of the drive unit in order to reduce its price, its size and the noise level of the machine in operation, since the noise level and the torque are closely related. Various parameters can be modified in order to reduce the drum torque: for example, reducing the inertia of the drum or not stopping the movement of the drum between two consecutive print operations (cf. EP-A-0 545 769).

SUMMARY OF THE INVENTION

The aim of the invention is to propose a different approach, based on a dynamic study of the movement of the drum which shows that the torque needed to accelerate the latter is inversely proportional to the angle of acceleration of the drum.

The invention also concerns a method of controlling a print drum enabling a substantial reduction in the drive torque based on reversing the direction of rotation of the drum in the operating cycle of the latter in order to increase the acceleration angle.

The invention also concerns a device for controlling a machine for printing articles "on the fly", particularly for franking envelopes, of the type including:

print means comprising a rotary print drum driven by a first motor, said print drum carrying an active print part on a portion of its surface;

transport means for said articles driven by a second motor, feeding said articles in contact with said print means at a given transport speed Vt and extracting the printed articles;

means for controlling the rotation speed of said first motor so that the tangential speed of said print drum is maintained equal to said transport speed Vt during a printing phase corresponding to the time period for which an article is in contact with said active print part and, outside the printing phase, reduced during a deceleration phase following the printing phase, and increased to the speed Vt during an acceleration phase preceding the next printing phase, characterised in that said control means are adapted to impart a negative speed to the drum after (preferably immediately after) the deceleration phase (and therefore before the next acceleration phase).

Advantageously, the speed is reduced linearly from Vt to a minimal negative speed and then increased linearly from the latter to Vt during the next printing operation.

The invention also concerns a method of controlling a printing machine having a rotary drum, particularly for franking envelopes, of the type in which after each printing operation at constant rotation speed in a given direction the rotation speed of the drum is decreased and, before each next printing operation, the rotation speed of the drum is increased in the same direction up to said constant speed, characterised in that the rotation direction of the drum is reversed after reducing the rotation speed after each printing operation.

The features and advantages of the present invention will emerge from the following description of one embodiment shown in the appended drawings.

DETAILED DESCRIPTION OF THE PREFERRED EMBODIMENTS

Figure 1:
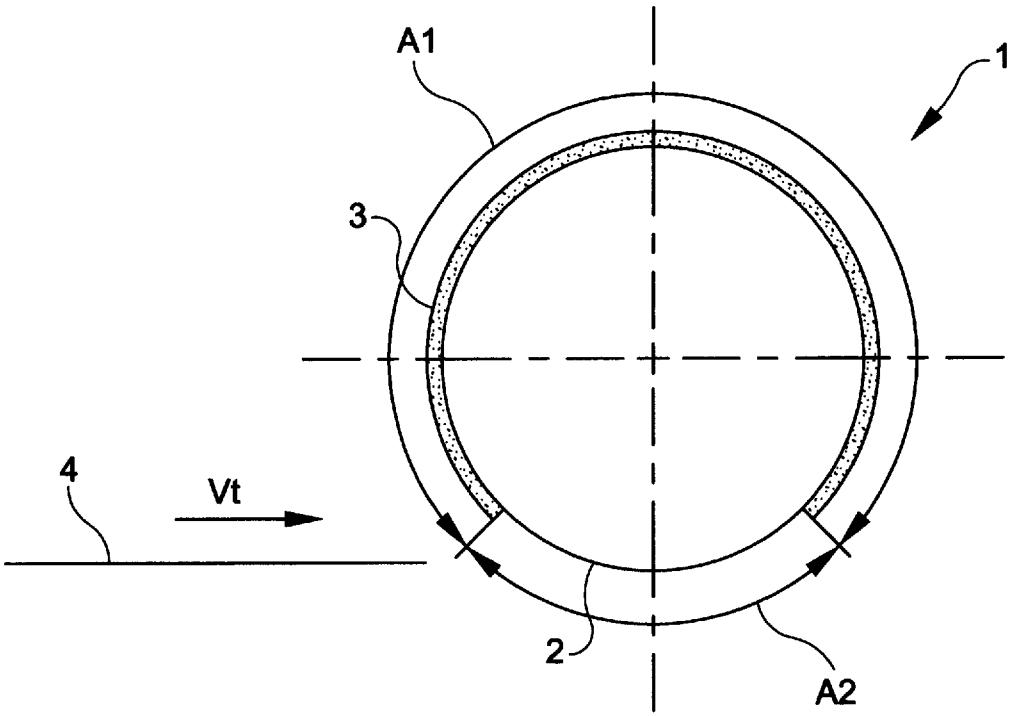
FIG. 1 is a simplified front view of a print drum.

FIG. 1 shows a print drum 1 made of a support cylinder 2 and an area 3 carrying the engraving. The area 3 is engraved with the design of the required imprint. The area 3 subtends an angle A1 less than 360°. Printing a mark on an envelope travelling at a transport speed Vt entails rotating the support cylinder 2, and therefore the area 3, so that the tangential peripheral speed of the latter is equal to Vt. The area 3 does not include the angle A2, the angle complementary to A1. It prevents contact of an envelope 4 with the area 3 as the envelope 4 leaves the printing device. The acceleration and deceleration of the print drum take place within this angular sector A2.

Figure 2:
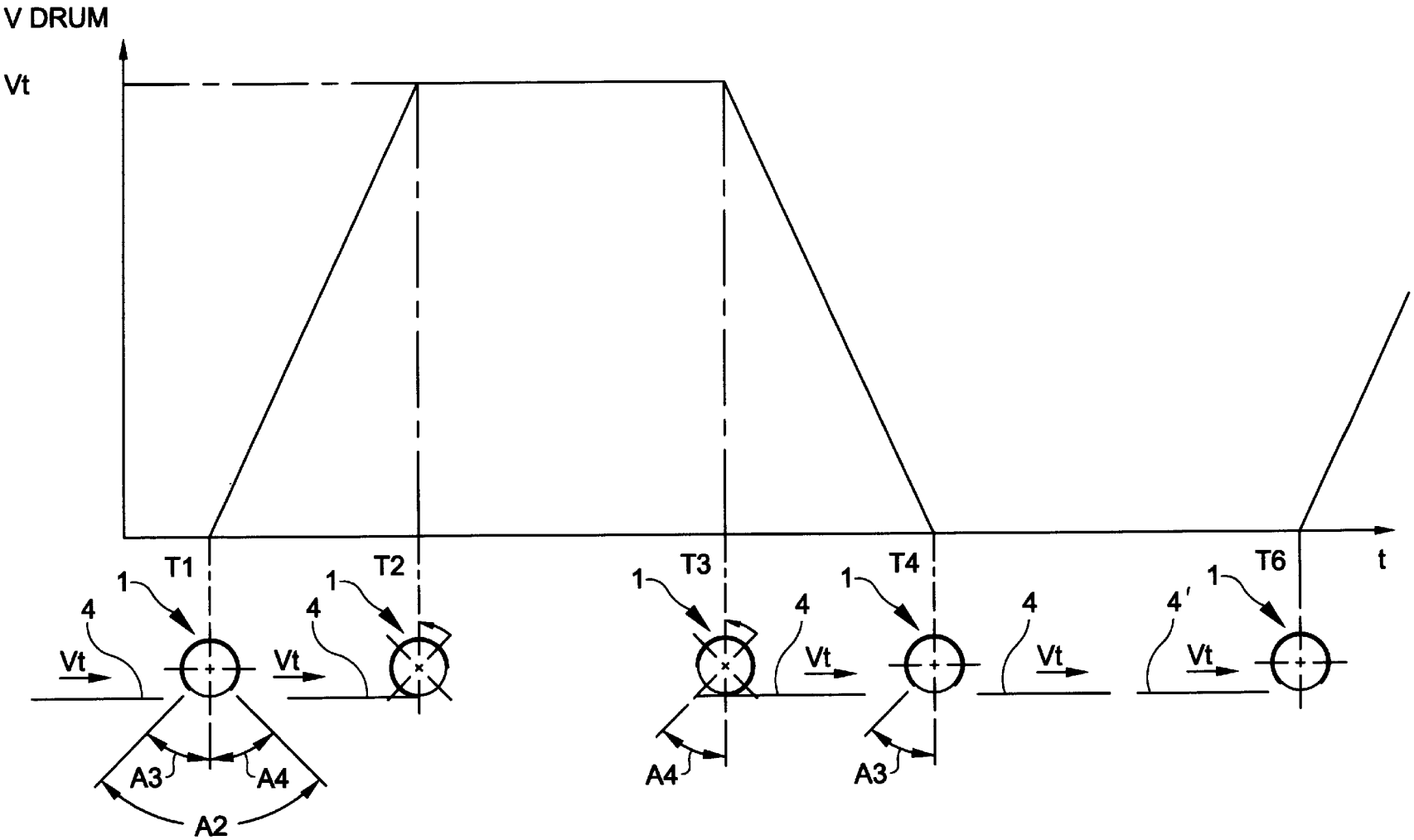
FIG-2 PRIOR ART
FIG. 2 shows the speed profile of a print drum using the conventional control method, noteworthy points on the profile being associated with a diagrammatic representation of the print drum.

FIG. 2 illustrates the prior art. It shows the profile of the peripheral speed of the print drum 1 during a print cycle. The drum is initially at rest. An envelope 4 is fed by a transport system towards the print drum 1 at the transport speed Vt. The transport system includes means for identifying the position of the envelope 4 relative to the print drum 1. When the envelope is at a certain position, at time T1, the microprocessor controlling the machine starts the drum 1 rotating. Between T1 and T2 the drum 1 is accelerated at a constant rate such that the linear peripheral speed of the drum 1 at T2 is equal to the transport speed Vt of the envelope. Between the time T1 and the time T2 the drum 1 has rotated through the acceleration angle A3. Between T2 and T3 the area 3 applies its mark to the envelope 4. When the printing is finished at T3 the drum 1 is decelerated at a constant rate such that its linear speed is zero at T4. Between the time T3 and the time T4 the drum 1 rotates the deceleration angle A4. In theory the angles A3 and A4 are equal, and each has the value A2/2. In practice mechanical friction makes it easier to brake than to accelerate. In practice A3 is therefore slightly greater than A4. The envelope 4 has therefore received its mark and left the printing area. A subsequent envelope 4' arrives at time T6 and the drum 1 performs the same cycle as previously. This type of speed profile is known as a "trapezoidal speed profile". To cater for varying entry frequencies and entry speeds, it may be advantageous not to stop the drum rotating between T4 and T6. This technique is described in patent EP-A-0 545 749 (FIG. 5*a*). In these embodiments the rotation speed of the drum is always anticlockwise and greater than or equal to zero.

Figure 3:
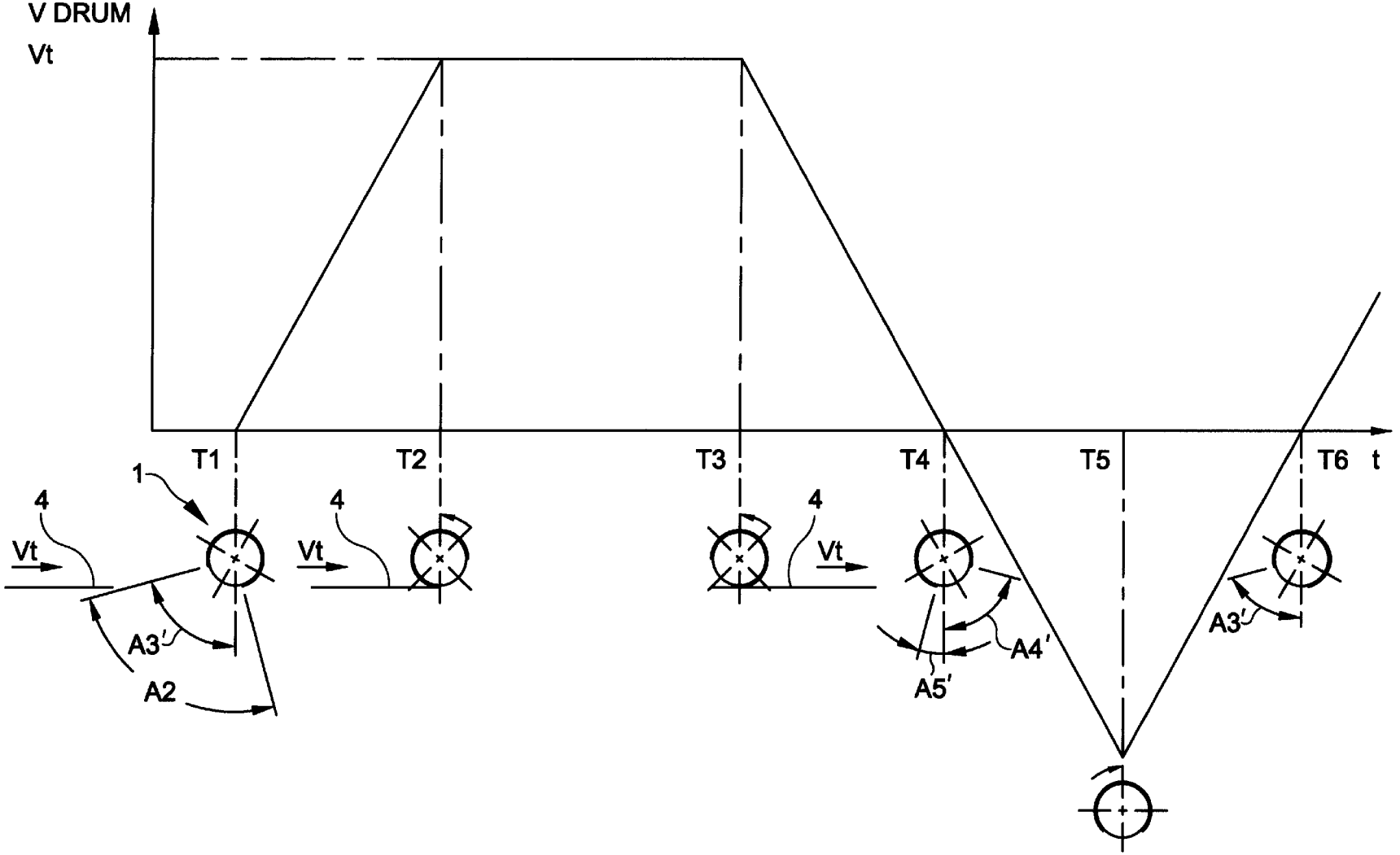
FIG. 3 shows the speed profile of a print drum controlled in accordance with the invention, using the same conventions.

FIG. 3 shows the peripheral speed profile of the drum 1 during a printing cycle in accordance with the invention. The drum is initially stopped in a position different than that of FIG. 2. The angle A3' between the leading edge of the print area and the vertical is significantly greater than A2/2. Between T1 and T2 the drum 1 is accelerated at a constant rate so that at T2 its linear speed is equal to the transport speed Vt of the envelope. Between the time T1 and the time T2 the drum rotates through the acceleration angle A3'. Between T2 and T3 the print area 2 applies its mark to the envelope 4. When the printing is finished at T3, the drum is decelerated at a constant rate so that its linear speed is zero at T4. Between the time T3 and the time T4 the drum rotates through a deceleration angle A4'. In theory the angles A3' and A4' are equal. At T4, the angle A5' being very much less than A3', it is impossible to process the next envelope in this position. To position the drum correctly, from T4 the rotation direction of said drum is reversed, up to a minimal negative speed (i.e. a maximal speed in absolute value) at T5, to return the drum at T6 to the position it was in at T1. Between T4 and T6, as the print area 2 is not in contact with the article 4 that has just been printed, it is possible to rotate the drum in a clockwise direction. This is done in two phases: constant acceleration up to T5 followed by constant deceleration up to T6. This type of speed profile is not of the trapezoidal type as in FIG. 1. The operating cycle of the drum therefore systematically incorporates a reverse movement that enables operation of said drum with a significantly greater acceleration angle than in the prior art.

What is claimed is:

1. Device for controlling a machine for printing articles (4), particularly for franking envelopes (4), of the type including:

print means comprising a rotary print drum (1) driven by a first motor, said print drum (1) carrying an active print part (3) on a portion of its surface;

transport means for said articles (4) driven by a second motor, feeding said articles (4) in contact with said print means at a given transport speed Vt and extracting the printed articles (4);

means for controlling the rotation speed of said first motor so that the tangential speed of said print drum (1) is maintained equal to said transport speed Vt during a printing phase corresponding to the time period for which an article (4) is in contact with said active print part (3) and, outside the printing phase, reduced during a deceleration phase following the printing phase, and increased to the speed Vt during an acceleration phase preceding the next printing phase, characterised in that said control means are adapted to impart a negative speed to the drum (1) after each deceleration phase.

2. Device according to claim 1 characterized in that the tangential speed of said print drum is reduced linearly from Vt to a minimal negative speed and then increased linearly from the minimal negative speed to Vt.

3. Method of controlling a printing machine having a rotary drum (1), particularly for franking envelopes (4), of the type in which after each printing operation at constant rotation speed in a given direction the rotation speed of the drum (1) is decreased and, before each next printing operation, the rotation speed of the drum is increased in the same direction up to said constant speed, characterised in that the rotation direction of the drum (1) is reversed after reducing the rotation speed after each printing operation.

4. A method as claimed in claim 3, wherein the rotation speed of the drum is reduced linearly from a tangential speed equal to Vt to a minimal negative speed.

5. A method as claimed in claim 3, wherein the rotation speed of the drum is increased linearly from a tangential speed equal to a minimal negative speed to Vt.

6. A method as claimed in claim 3, wherein the rotation speed of the drum is decreased at a constant rate.

7. A method as claimed in claim 3, wherein the rotation speed of the drum is increased at a constant rate.

8. A franking machine comprising:

a rotary print drum having an initial starting point and an active print part on a portion of a surface thereof;

a first motor for driving said print drum;

means for transporting articles to be in contact with the active print part of said print drum;

a second motor for driving said transport means at a constant speed;

a controller for controlling the rotational speed and direction of said first motor; and wherein the controller enables the first motor to rotate the print drum in a first direction through a first acceleration phase to a tangential speed equal to the constant speed of the transport means to establish a printing phase such that said active print part is in contact with the article, a deceleration phase following the printing phase in which the print drum rotates past the initial starting point, and, after the deceleration phase, the controller rotating the drum in a second direction opposite to the first direction thereby bringing the print drum back to the initial starting point.

9. A franking machine according to claim 8, wherein the tangential speed of said print drum is reduced linearly from the constant speed of the transport means to a minimal negative speed.

10. A franking machine according to claim 8, wherein the tangential speed of said print drum is increased linearly from the minimal negative speed to the constant speed of the transport means.

11. A method of controlling a printing machine for franking envelopes comprising the steps of accelerating a rotary drum in a first direction from an initial starting point to a constant rotation speed;

printing an envelope at said constant rotation speed;

decelerating said rotary drum from said constant rotation speed to zero and past the initial starting point; and rotating the rotary drum in a second direction opposite to the first direction to bring said rotary drum back to the initial starting point after each decelerating step.

12. A method as claimed in claim 11, wherein the rotation speed of said rotary drum is reduced linearly from said constant speed to a minimal negative speed.

13. A method as claimed in claim 11, wherein the rotation speed of said rotary drum is increased linearly from a minimal negative speed to said constant speed.

14. A method as claimed in claim 11, wherein the rotation speed of said rotary drum is decreased at a constant rate.

15. A method as claimed in claim 11, wherein the rotation speed of said rotary drum is increased at a constant rate.

* * * * *